US005975990A

United States Patent [19]

Malcok

[11] Patent Number: 5,975,990

[45] **Date of Patent: *Nov. 2, 1999**

[54] METHOD OF PRODUCING SEMICONDUCTOR WAFERS

[75] Inventor: Hanifi Malcok, Burghausen, Germany

[73] Assignee: Wacker Siltronic Gesellschaft für Halbleitermaterialien AG, Burghausen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,023

[22] Filed: Dec. 2, 1996

[30] Foreign Application Priority Data

Feb. 29, 1996 [DE] Germany ..... 196 07 695

[51] Int. Cl.[6] ..... B24B 49/10

[52] U.S. Cl. ..... 451/41; 451/11; 451/65; 451/69; 125/13.01

[58] Field of Search ..... 451/41, 65, 69, 451/70, 9, 10, 11; 125/13.01, 13.02, 12

[56] References Cited

U.S. PATENT DOCUMENTS

| | | | |
|---|---|---|---|
| 4,138,304 | 2/1979 | Gantley | 125/13.01 |
| 4,227,348 | 10/1980 | Demers | 125/13 |
| 4,844,047 | 7/1989 | Brehm et al. | 125/13.01 |
| 4,967,461 | 11/1990 | Feldmeier . | |
| 4,991,475 | 2/1991 | Malcok et al. . | |
| 5,025,593 | 6/1991 | Kawaguchi et al. | 125/13.01 |
| 5,329,733 | 7/1994 | Steere, Jr. . | |
| 5,458,526 | 10/1995 | Tsukada et al. | 451/41 |

FOREIGN PATENT DOCUMENTS 0417644 3/1991 European Pat. Off. .

OTHER PUBLICATIONS

Patent Abstracts of Japan, vol. 007, No. 012 (M–186), Jan. 19, 1983 & JP57168854 A (Toukyiou Seimitsu: KK).

*Primary Examiner*—Eileen P. Morgan
*Attorney, Agent, or Firm*—Collard & Roe, P.C.

[57] ABSTRACT

A method for producing semiconductor wafers is by a repeated sequence of grinding the end face of a monocrystal using a grinding tool and cutting a semiconductor wafer having a thickness from the monocrystal using a cutting tool, a grinding abrasion of a specified depth being produced during grinding and the semiconductor wafer being cut in a cutting plane which is as parallel as possible to the ground end face. The method includes (a) simultaneously grinding a part of the surface of an auxiliary body, to produce a ground surface of the auxiliary body and the end face of the monocrystal lying substantially in one plane and the thickness of the material abraded from the auxiliary body by grinding being substantially equal to the grinding abrasion; (b) cutting into the auxiliary body in the cutting plane using the cutting tool and producing a cut section which has a ground part and an unground part, and (c) determining the grinding abrasion, either (1) as the distance between the ground surface of the auxiliary body and the surface of the auxiliary body before grinding, or (2) as the difference in the thickness of the cut section in the unground part and the thickness of the semiconductor wafer.

6 Claims, 1 Drawing Sheet

METHOD OF PRODUCING SEMICONDUCTOR WAFERS

BACKGROUND OF THE INVENTION

1. Field of the Invention

The present invention relates to a method for producing semiconductor wafers by a repeated sequence of grinding the end face of a monocrystal using a grinding tool and cutting a semiconductor wafer from the monocrystal using a cutting tool, a grinding abrasion of a specified depth being produced during grinding, and the semiconductor wafer being cut in a cutting plane which is as parallel as possible to the ground end face.

2. The Prior Art

The grinding of the end face of the monocrystal produces a first flat side face on the semiconductor wafer. After the semiconductor wafer is separated from the monocrystal, this first flat side face is used as a reference face and the opposite side face is ground parallel to this reference face. The desired result is a semiconductor wafer having flat and parallel side faces. U.S. Pat. No. 4,967,461 describes how the grinding of the end face of the monocrystal eliminates unevenness which is attributable to deflections of the saw blade during the cutting of a semiconductor wafer and which would result in warped semiconductor wafers. Conventionally, the saw blade of an annular saw is used as the cutting tool. While the saw blade is working through the monocrystal, sawing forces occur which deflect the saw blade from the intended cutting plane situated parallel to the ground end face of the monocrystal. The actual cutting plane is therefore not completely flat, but slightly curved and this unevenness is reflected in the quality of the end face of the monocrystal. Before the next semiconductor wafer can be cut, the end face has to be ground flat again.

The repeated sequence of grinding the end face of the monocrystal and cutting a semiconductor wafer from the monocrystal applies stresses both to the grinding tool and to the cutting tool. The condition of the grinding tool can be determined with a perthometer. However, this requires a fairly long shutdown time for the grinding machine since the investigation is carried out on the grinding tool and much time has to be expended on dismantling and reassembly and also on the readjustment of the grinding tool. Wear phenomena or changes in operating parameters may result in the deflection behavior of the saw blade altering over the course of time. These changes may alter the cutting pattern when a semiconductor wafer is being cut, and lead to a different cutting pattern from the cutting pattern that results when a subsequent semiconductor wafer is later being cut. Sensors were therefore developed to enable alterations in the cutting pattern to be observed and followed even during the cutting operation. Suitable sensors are described, for example, in U.S. Pat. No. 4,991,475.

When the end face of the monocrystal is being ground, an attempt is made to keep the grinding abrasion to a minimum. The grinding abrasion is specified in a length unit. It corresponds to the distance between the ground end face and the highest material elevation on the unground end face. If the resulting grinding abrasion is too high, material is wasted and the yield of semiconductor wafers per monocrystal is reduced. If the grinding abrasion is too low, the unevenness on the end face of the monocrystal is not adequately removed and the semiconductor wafers produced are defective.

A specified grinding abrasion can be set very accurately with the aid of the feed unit which moves the grinding tool and/or moves the monocrystal for the purpose of grinding. A predetermined required grinding abrasion may, however, soon prove to be too low, for example, because the magnitude of the deflection of the saw blade has increased during the course of the wafer production. On the other hand, the saw gap in the monocrystal due to the saw blade may become thinner, for example, as a consequence of wear of the saw blade. This wear will cause the result that, if the original grinding abrasion is maintained, more material would be ground from the end face of the monocrystal than necessary.

Since the reference grinding abrasion and the necessary actual grinding abrasion may be different, there is an urgent requirement to be able to determine the grinding abrasion at least from time to time. However, this is difficult to do. One known method is to cut a semiconductor wafer from the monocrystal at regular intervals without the end face of the monocrystal being previously ground beforehand. The grinding abrasion is then measured directly from the thickness of the semiconductor wafer, provided the cutting conditions have not changed since the penultimate cutting of a semiconductor wafer. Constant cutting conditions may be assumed if sensors do not reveal any substantial alteration in the cutting pattern during the cutting of two consecutive semiconductor wafers. A disadvantage of this known method described above, in particular, is that the semiconductor wafer investigated becomes a reject and reduces the yield, because it lacks the flat reference face and cannot be used as intended.

SUMMARY OF THE INVENTION

It is therefore an object of the present invention to provide improvement in the production method for semiconductor wafers and, in particular, to provide a more advantageous method for determining the grinding abrasion.

The present invention achieves the above object by providing a method for producing semiconductor wafers by a repeated sequence of grinding an end face of a monocrystal using a grinding tool and cutting a semiconductor wafer having a thickness from the monocrystal using a cutting tool, a grinding abrasion of a specified depth being produced during grinding, and the semiconductor wafer being cut in a cutting plane which is as parallel as possible to the ground end face of the monocrystal, which method comprises the steps of (a) grinding a part of a surface of an auxiliary body to produce a ground surface of the auxiliary body and the surface of the auxiliary body and the end face of the monocrystal lying substantially in one plane, and thickness of material abraded from the auxiliary body by grinding being substantially equal to the grinding abrasion;

(b) cutting into the auxiliary body in the cutting plane using the cutting tool and producing a cut section which has a ground part and an unground part; and (c) determining the grinding abrasion, either (1) as the distance between the ground surface of the auxiliary body and a surface of the auxiliary body before grinding or (2) as the difference in thickness of the cut section in the unground part and the thickness of the semiconductor wafer.

Thus, there are two method embodiments regarding the process steps (c)(1) and (c)(2) above for determining the grinding abrasion in the present invention.

The grinding abrasion can be determined at intervals, for example, whenever a specific number of semiconductor wafers has been produced. However, it is also possible to determine the grinding abrasion for every semiconductor wafer produced. The grinding abrasion is preferably determined when the monitoring of the saw blade has revealed that the cutting conditions have not changed substantially during the cutting of two consecutive semiconductor wafers. Neither is the wafer production procedure delayed nor is the yield of semiconductor wafers impaired.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, wherein similar reference characters denote similar elements throughout two views.

DETAILED DESCRIPTION OF PREFERRED EMBODIMENTS

Figure 1:
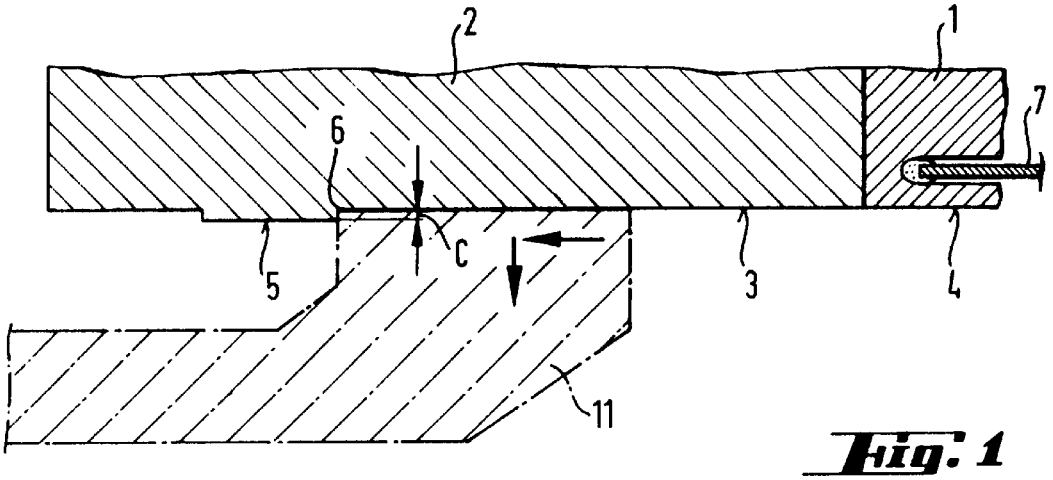
FIG. 1 shows diagrammatically the conditions during the grinding of the end face of a monocrystal.

Turning now in detail to the drawings, FIG. 1 shows that the grinding can be carried out either before, or simultaneously with, the cutting of a semiconductor wafer. FIG. 1 shows not only the grinding of the end face of the monocrystal 1, but also shows the grinding of the surface of an auxiliary body 2. This surface is substantially in the same plane as the unground end face. The choice of type of auxiliary body is substantially unlimited. A possibility exists, however, to use a bar composed, for example, of carbon for this purpose, which is in any case conventionally used as an auxiliary in cutting semiconductor wafers. This bar is joined to the monocrystal, for example by means of an adhesive, and prevents a semiconductor wafer from being damaged during the cutting from the monocrystal.

In addition to the end face of the monocrystal, a part of the surface of the auxiliary body is also ground with the grinding tool 11, the grinding abrasion in the case of the monocrystal being substantially equal to the grinding abrasion in the case of the auxiliary body. Consequently, the ground surface 3 of the auxiliary body and the ground end face 4 of the monocrystal are located in the same plane.

Figure 2:
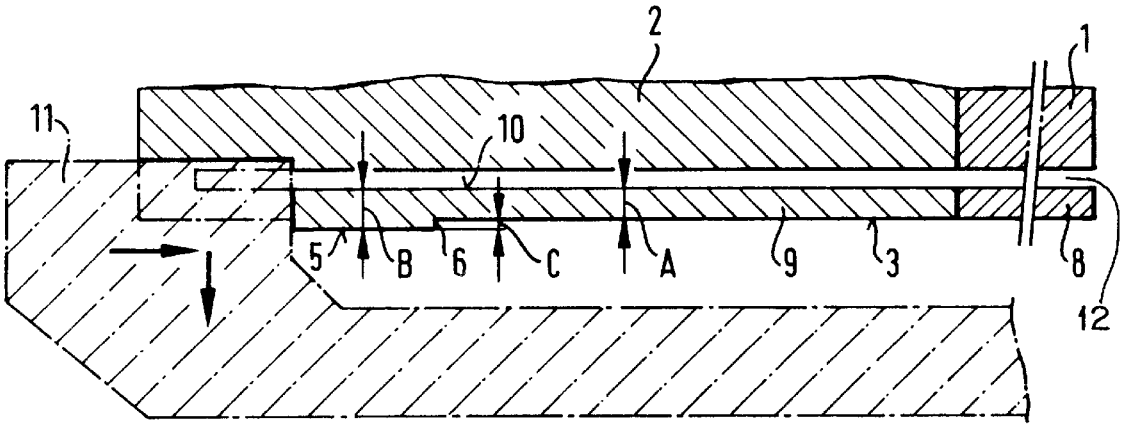
FIG. 2 shows the conditions during the cutting of a semiconductor wafer from the monocrystal.

As shown in FIG. 2, the distance C between the unground surface 5 of the auxiliary body 2 and the ground surface 3 of the auxiliary body 2 is equal to the grinding abrasion actually produced. In principle, this distance C can be measured by inspecting the depth of the step 6 produced during grinding. It is, however, preferable to use the semiconductor wafer 8 cut by the cutting tool 7 for this determination. The cutting plane 12 in which the cutting tool works through the monocrystal should be as parallel as possible to the ground end face 4. In this cutting plane, the auxiliary body 2 is also cut into by using the cutting tool so that a cut section 9 is produced on the auxiliary body 2 on whose front side there is the step 6. The grinding abrasion C actually produced is given by the difference in the thickness B of the cut section 9 and the thickness A of the auxiliary body. The thickness B is equal to the distance between unground surface 5 of the auxiliary body and the back 10 of the cut section cut out by the cutting tool.

In practice, after the cutting tool has been used, the join between the cut section and the remainder of the auxiliary body is parted using the grinding tool and the semiconductor wafer and the cut section are picked up by a wafer pickup means. Optionally, the thickness of the two objects is measured after cutting. Also multiple measurements are possible, such that a mean value for the thickness of the semiconductor wafer and for the cut section are determined in each case. An automated thickness measurement is preferred.

The cut section 9 is also useful in other respects. Its ground surface 3 can be investigated with a perthometers. On the basis of this investigation, it is possible to draw conclusions about the profile of the grinding tool and any wear of the grinding tool can be revealed as promptly as possible.

According to a further embodiment of the method of the invention, it is possible to observe and to keep track of the deflections of the saw blade from the intended cutting plane situated parallel to the ground end face of the monocrystal and to determine on the basis thereof, a required grinding abrasion by calculation. The required grinding abrasion is equal as much as possible to that grinding abrasion which is just sufficient to achieve a flat end face by grinding. If the required grinding abrasion determined differs from that reference grinding abrasion to which the feed unit was originally set, then the feed unit is reprogrammed automatically or manually to a new reference required grinding abrasion. The grinding abrasion which then actually takes place is determined in the manner described above and compared with the new reference required grinding abrasion.

While several embodiments of the present invention have been shown and described, it is to be understood that many changes and modifications may be made thereunto without departing from the spirit and scope of the invention as defined in the appended claims.

What is claimed is:

1. A method for producing a semiconductor wafer comprising the steps of providing a monocrystal having an outer edge and an end face;

providing an auxiliary body having a face;

joining the monocrystal and the auxiliary body such that the end face of the monocrystal and the face of the auxiliary body are lying substantially in the same plane;

grinding using a grinding tool the end face of the monocrystal and a part of the face of the auxiliary body, a ground face of the monocrystal, a ground portion of the face of the auxiliary body and an unground portion of the face of the auxiliary body being left after grinding, the grinding tool performing a preset feed movement during said grinding;

cutting using a cutting tool into the monocrystal and into the auxiliary body in a cutting plane which is parallel to the ground face of the monocrystal and parallel to the ground portion of the face of the auxiliary body, a semiconductor wafer and a cut section of the auxiliary body being left after cutting, said cut section having a face comprising the ground portion and the unground portion of the face of the auxiliary body;

separating the cut section and the semiconductor wafer from the auxiliary body;

measuring the distance between the ground portion and the unground portion of the face of the auxiliary body and defining said distance as actual grinding abrasion;

comparing the actual grinding abrasion to a value defined as reference grinding abrasion, said value determining the preset feed movement of the grinding tool; and adjusting said value if necessary before producing a further wafer.

2. The method as claimed in claim 1, comprising during the cutting of the semiconductor wafer, measuring a deflection of the cutting tool with reference to said cutting plane;

establishing a desired grinding abrasion as a function of the measured deflection; and adjusting the reference grinding abrasion to the established desired grinding abrasion.

3. The method as claimed in claim 1, comprising inspecting the ground portion of the face of the auxiliary body with a perthometer; and determining the wear of the grinding tool using the results of the perthometer measuring.

4. A method for producing a semiconductor wafer comprising the steps of providing a monocrystal having an outer edge and an end face;

providing an auxiliary body having a face;

joining the monocrystal and the auxiliary body such that the end face of the monocrystal and the face of the auxiliary body are lying substantially in the same plane;

grinding using a grinding tool the end face of the monocrystal and a part of the face of the auxiliary body, a ground face of the monocrystal, a ground portion of the face of the auxiliary body and an unground portion of the face of the auxiliary body being left after grinding, the grinding tool performing a preset feed movement during said grinding;

cutting using a cutting tool into the monocrystal and into the auxiliary body in a cutting plane which is parallel to the ground face of the monocrystal and parallel to the ground portion of the face of the auxiliary body, a semiconductor wafer and a cut section of the auxiliary body being left after cutting, said semiconductor wafer having a thickness and said cut section having a face comprising the ground portion and the unground portion of the face of the auxiliary body and said cut section having a thickness being the distance between the said unground portion and a back of the cut section;

separating the cut section and the semiconductor wafer from the auxiliary body;

measuring the difference between the thickness of the cut section and the thickness of the wafer and defining said difference as actual grinding abrasion;

comparing the actual grinding abrasion to a value defined as reference grinding abrasion, said value determining the preset feed movement of the grinding tool; and adjusting said value if necessary before producing a further wafer.

5. The method as claimed in claim 4, comprising during the cutting of the semiconductor wafer, measuring a deflection of the cutting tool with reference to said cutting plane;

establishing a desired grinding abrasion as a function of the measured deflection; and adjusting the reference grinding abrasion to the established desired grinding abrasion.

6. The method as claimed in claim 5, comprising inspecting the ground portion of the face of the auxiliary body with a perthometer; and determining the wear of the grinding tool using the results of the perthometer measuring.

* * * * *